US007905261B2

(12) United States Patent
Hamisch et al.

(10) Patent No.: US 7,905,261 B2
(45) Date of Patent: Mar. 15, 2011

(54) COVER ARRANGEMENT FOR A HOUSING OF A HAND-HELD POWER TOOL

(75) Inventors: Claus-Peter Hamisch, Esslingen (DE); Ralf Blechschmidt, Kernen (DE); Johannes Menzel, Wernau (DE); Tobias Wurster, Goppingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 1350 days.

(21) Appl. No.: 11/308,787

(22) Filed: May 4, 2006

(65) Prior Publication Data

US 2006/0254557 A1 Nov. 16, 2006

(30) Foreign Application Priority Data

May 13, 2005 (DE) ..... 20 2005 007 594 U
Jan. 24, 2006 (DE) ..... 10 2006 003 207

(51) Int. Cl.
*B65D 65/02* (2006.01)

(52) U.S. Cl. ..... 150/157; 123/90.38; 30/381

(58) Field of Classification Search ..... 16/413, 16/422, 431; 123/90.38, 198; 150/157, 161; 81/492; 30/272.1–277.4, 381–387
See application file for complete search history.

(56) References Cited

U.S. PATENT DOCUMENTS

| | | | | |
|---|---|---|---|---|
| 4,995,356 | A * | 2/1991 | Kronich | 123/198 E |
| 5,832,791 | A * | 11/1998 | Lin | 81/62 |
| 5,899,182 | A | 5/1999 | Martinsson et al. | 123/90.38 |
| 6,553,619 | B2 * | 4/2003 | Chen | 16/114.1 |
| 2003/0221292 | A1 * | 12/2003 | Pozgay et al. | 16/422 |
| 2006/0021196 | A1 * | 2/2006 | Blauer et al. | 16/431 |

* cited by examiner

*Primary Examiner* — Victor Batson
*Assistant Examiner* — Roberta Delisle
(74) *Attorney, Agent, or Firm* — Gudrun E. Huckett

(57) ABSTRACT

A housing cover arrangement of a hand-held power tool has a cover having a cover edge and a lateral surface delimited by the cover edge. At least one spring clip is provided that removably connects the cover to a part of the power tool. The at least one spring clip is disposed, when securing the cover to the part, on the lateral surface in the area of the cover edge and is oriented in a clamping direction that extends transversely to the cover edge. At least two supports are disposed along the cover edge and act in the clamping direction. The at least one spring clip is arranged between the at least two supports.

14 Claims, 4 Drawing Sheets

COVER ARRANGEMENT FOR A HOUSING OF A HAND-HELD POWER TOOL

BACKGROUND OF THE INVENTION

The invention relates to a cover arrangement for a housing of a hand-held power tool, for example, a chain saw, a cut-off machine, a trimmer or the like. The cover arrangement comprises a cover and at least one spring clip for securing the cover detachably to another part of the power tool. The spring clip is arranged at a lateral surface of the cover in the area of the edge of the cover correlated with the lateral surface. For clamping the cover relative to the other part, the spring clip is arranged in a clamping direction that is perpendicular to the edge of the cover.

Hand-guided power tools, such as motor chain saws, trimmers, cut-off machines and the like, are used in environments where they are exposed to high loads of dust and dirt. A drive motor of the power tool when configured as an internal combustion engine takes in combustion air through an intake tract. For removing dust from the incoming air, an air filter is provided. Such an air filter is secured in an air filter box that is closed by a detachable lid. The dust load of the air filter requires cleaning or exchange of the air filter from time to time; for this purpose, the cover of the air filter box must be opened. The same applies also to checking and exchanging the spark plug of the internal combustion engine; the spark plug and the cylinder head are both covered by an appropriate cover.

In addition to easy removability and easy attachment of the cover, a safe fixation of the cover in operation of the power tool is desired. The separating location between the cover and the additional part of the power tool to which the cover is attached is subjected to vibrations that cause wear at the separating location and moreover contribute to sound emission.

U.S. Pat. No. 5,899,182 discloses a housing cover arrangement of a hand-held power tool where the cover is connected by a spring clip to the motor housing. The spring clip is arranged at a lateral surface of the cover in the area of the cover edge that is correlated with the lateral surface and clamps the cover relative to the motor housing in a clamping direction that is perpendicular to the edge of the cover. For positionally securing the cover transversely to the clamping direction, a pin is provided whose longitudinal axis extends in the clamping direction. The pin engages a recess. An end face of the sleeve rests under the effect of the clamping force of the spring clip on an annular support plate made from metal. The arrangement as a whole is rigid and stiff. The spring clip is arranged in immediate vicinity of the rigid arrangement of pin and recess. The action of the clamping force is limited to the area immediately adjacent to the pin. Because this area is relatively stiff, the pretension of the spring clip is based solely on the elastic deformability of the spring clip. Wear and position tolerances can lead to undesirable fluctuations with regard to spring pretension. The rigid contact between cover and motor housing leads to sound traveling from the motor into the cover and being radiated away from the cover.

SUMMARY OF THE INVENTION

It is an object of the present invention to configure a cover arrangement of the aforementioned kind such that a reliable and robust cover attachment is provided.

According to the invention it is proposed that along the edge of the cover at least two primary supports are provided that act in the clamping direction. The spring clip is arranged between the primary supports. In particular, the spring clip has a lateral spacing relative to the first support and relative to the second support. A ratio of the two lateral spacings relative to one another is approximately within the range of 1 (inclusive) and 2½ (inclusive), in particular 2 (inclusive).

The arrangement of the spring clip between the two primary supports has the effect that its clamping force is distributed onto both primary supports. Within the indicated ratio of lateral spacings, a sufficiently uniform force distribution onto both primary supports is ensured. Between both primary supports the cover and/or the adjoining part can elastically deform within certain limits. This elastic deformation is additive to the elastic deformation of the spring clip. Therefore, a greater spring travel is available that makes the constructively provided clamping force acting on the mounted cover more uniform. The arrangement is robust with regard to positional tolerances and wear. Weakening of the spring pretension by wear as well as an increase of the spring pretension by dirt deposits are compensated at least partially.

In a preferred embodiment, the support has an elastic intermediate layer, in particular, made from elastomeric plastic material. The elastic intermediate layer increases the available spring travel and contributes to maintaining the provided clamping force. At the same time, the elastic intermediate layer acts as a damping element. Structure-borne sound and other vibrations are transmitted only to a limited extent from the motor onto the housing. The sound emission from the housing is reduced.

In a preferred embodiment, a device for providing a lateral position securing action in a direction transverse to the clamping direction is provided in the area of the support. In particular, for configuring the support and for configuring the lateral position securing device, a pin is provided that engages a receiving sleeve, wherein the elastic intermediate layer is arranged in the clamping direction between the pin and the bottom of the receiving sleeve.

Accordingly, in the area of each one of the primary supports there is also a lateral position securing device, respectively. Both are loaded in the same way by the force of the spring clip and are safely held. The cover is reliably secured against lateral sliding. The action of the spring clip can therefore be limited to the application of the clamping force. The spring clip must not provide its own lateral securing function. Accordingly, its configuration can be much simpler. Also, handling of the spring clip is simplified.

In an advantageous further embodiment, the elastic intermediate layer is embodied as an end member of the pin and engages in particular like a wedge an opening in the bottom of the receiving sleeve so that the pin has a minimal lateral play relative to the receiving sleeve. The configuration of the intermediate layer as an end member of the pin ensures that its elastic property acts primarily in the direction of the longitudinal axis of the pin, i.e., in the clamping direction. The lateral guiding precision is not impaired by this. The wedge-like engagement, for example, by configuring the end member in a cone shape (leading to a wedge-shaped cross-section), ensures a self-centering position-precise positioning action. The minimal lateral play of the pin relative to the receiving sleeve is dimensioned such that in the lateral direction a sufficiently high guiding precision is provided. On the other hand, the pin in connection with the elastic end member can perform minimal swivel movements transversely to its longitudinal axis. A minimal elastic sagging deformation of the cover is therefore not impaired.

It was found that a material pair in which the pin is made from plastic material and the receiving sleeve is made from metal provides excellent wear resistance. The plastic material of the pin rests in the lateral direction against the metal of the receiving sleeve. The aforementioned material pair is robust with regard to vibration loads.

The cover advantageously has no guiding function relative to other part in the area of the spring clip in a lateral direction transverse to the clamping direction. The lateral guiding action for the cover is provided only in the area of the primary supports positioned at a spacing to the spring clip. The spring clip itself is free of lateral forces. Only clamping forces in the clamping direction are active in its area. The cover arrangement is robust in regard to position tolerances and is simple in regard to configuration and handling.

In an expedient embodiment, in the immediate action range of the spring clip an additional support acting in the clamping direction is provided and has lateral play. Expediently, the additional support in the unloaded state of the spring clip has play in the clamping direction; the play is designed such that it can be overcome in the clamped state of the spring clip by elastic deformation of the neighboring structural components.

The additional support that is arranged together with the spring clip between the two primary supports enhances the distribution of the contact forces. Spot peak loads are prevented. Play in the clamping direction ensures that during the clamping step first the two outer primary supports are pretensioned. Only upon further increase of the clamping force when pushing the spring clips into their proper clamping position, the additional central support becomes active. A uniform force distribution is ensured.

In a preferred embodiment, the additional support is formed by a metal stay and a plastic receiving recess for the metal stay. This also provides a material pair that is wear-resistant with regard to vibration loading.

In addition to its function as a part of the central support, the metal stay forms expediently also an attachment point for the spring clip. The pretension force of the spring clip and the oppositely acting support force at the additional support are coaxial relative to one another. Precisely defined clamping conditions are provided while eccentricities are avoided.

DESCRIPTION OF THE PREFERRED EMBODIMENTS

Figure 1:
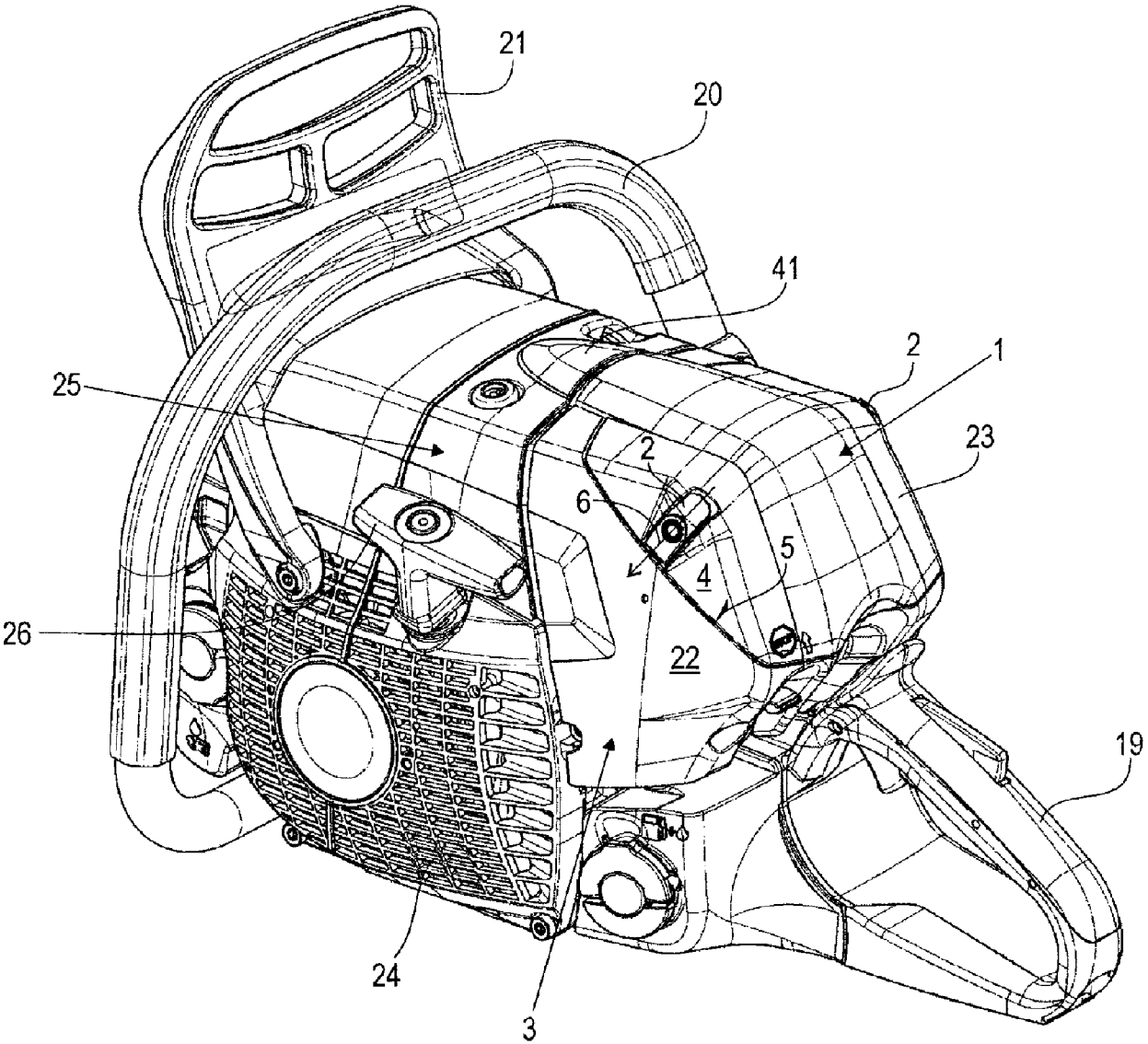
FIG. 1 is a perspective illustration of a hand-held power tool embodied as a motor chain saw with a housing cover arrangement according to the invention.

The overview illustration according to FIG. 1 shows a hand-guided power tool embodied as a motor chain saw. The power tool can also be a trimmer, a cut-off machine or the like. The chain saw is provided with a motor housing 24 on which a guide bar for a circulating saw chain (not shown in order to simplify the illustration) is mounted. In the motor housing 24, a drive motor in the form of an internal combustion engine 25 (not illustrated in detail) is arranged for driving the saw chain. Instead of the internal combustion engine 25 an electric motor can be provided. For starting the combustion engine 25, a pull rope starter 26 is provided. For guiding the chain saw, a rear handle 19 and a front handle 20 are attached to the motor housing 24. In front of the front handle 20, a brake lever 21 is provided with which a brake device for stopping the saw chain is triggered.

In operation, the internal combustion engine 25 takes in combustion air through an intake tract. In a carburetor (not illustrated), fuel is introduced into the combustion air flow and an ignitable fuel/air mixture is generated. Upstream of the carburetor an air filter for cleaning the combustion air flow is provided. The exchangeable air filter is secured in an air filter box 22. The cylinder head of the internal combustion engine 25 with screwed-in spark plug is partially covered by a cylinder cover 41 while the air filter box 22 in operation is covered by air filter box cover 23. In the mounted state, the air filter box 22 and the air filter box cover 23 together act as an additional cover part for the cylinder of the internal combustion engine 25.

The arrangement according to the invention comprises a cover 1 and at least one spring clip 2 for removable attachment of the cover 1 on another part 3 of the power tool. As an example, the cover 1 is the air filter box cover 23 and the other part 3 is the air filter box 22. The same type of attachment can also be used for attaching the cylinder cover 41 to the internal combustion engine 25 or to the motor housing 24 or for attaching the air filter box 22 on another structural component of the power tool. Also, other comparable cover arrangements are conceivable.

In a closed position, the cover 1 in the form of the air filter box cover 23 is to be clamped and attached by at least one spring clip 2—in the illustrated embodiment two spring clips 2—relative to the part 3 in the form of the air filter box 22; the spring clips 2 will be described in more detail in the following. Box 22 and cover 23 together surround and protect the air filter contained therein without impairing the supply of combustion air. In addition to the actual cover function, the air filter box cover 23 can also have the function of securing the air filter in the air filter box 22.

The two spring clips 2 are arranged on a lateral surface 4 of the cover 1, respectively, in the area of a cover edge 5 correlated with the lateral surface 4. In the mounted state of the cover 1, the spring clips 2 clamp the cover 1 relative to the part 3 of the power tool in a clamping direction 6 that is perpendicular to the cover edge 5 and positioned approximately in the plane of the lateral surface 4.

After releasing one or several spring clips 2, the air filter box cover 23 can be removed from the air filter box 22 so that the air filter is accessible. Instead of a being completely removable, it is also possible to provide a swivel attachment of the air filter box cover 23.

Figure 2:
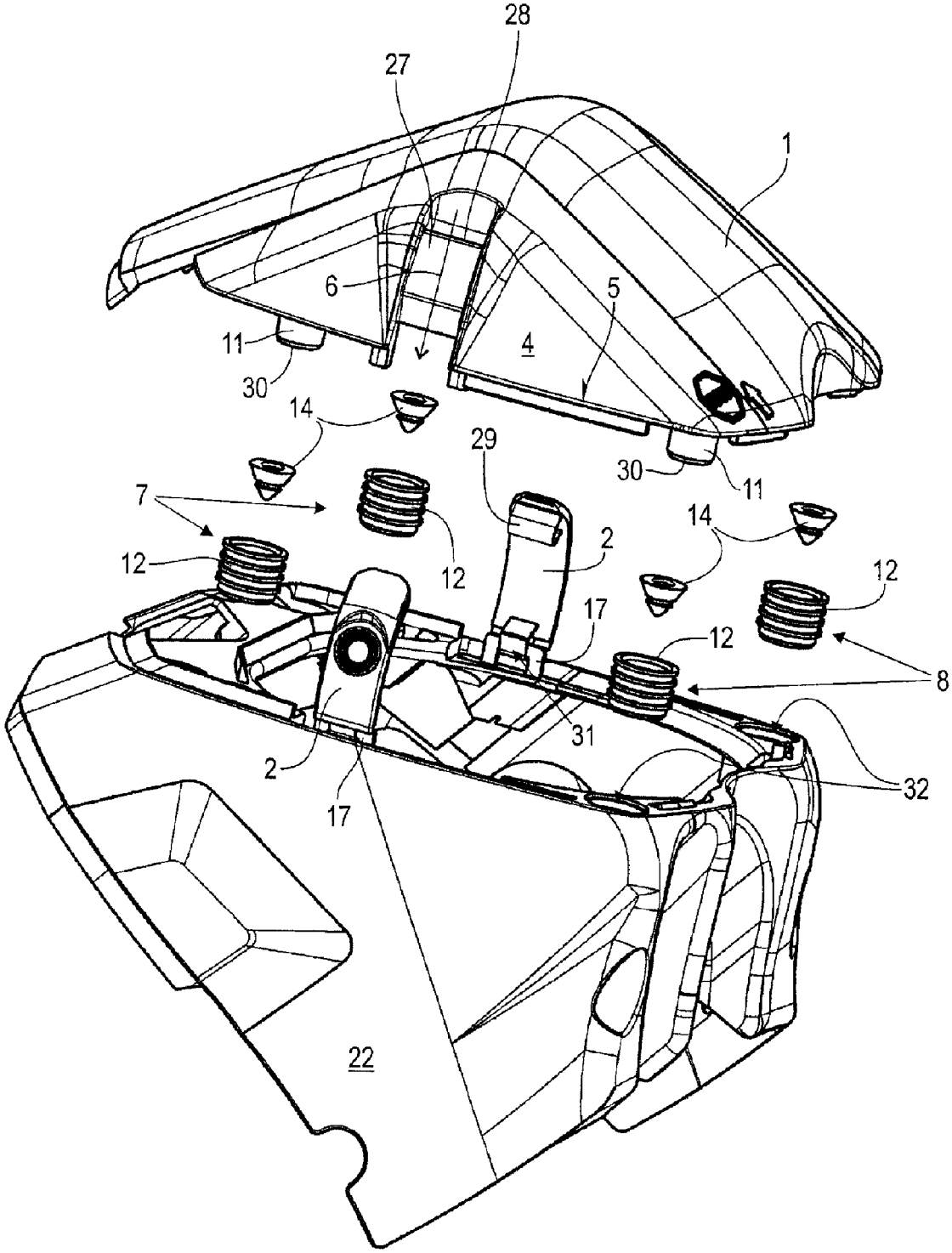
FIG. 2 is an exploded view of the housing cover arrangement according to FIG. 1 with details of the arrangement of the spring clips and the laterally positioned primary supports.

In the exploded view shown in FIG. 2, details of the housing cover arrangement according to FIG. 1 are shown. Along the cover edge 5 that delimits the lateral surface 4 of the cover 1 and adjoins in the mounted state the air filter box 22, two primary supports 7, 8 are provided that act in the clamping direction 6. In the mounted state, the primary supports 7, 8 provide a force transmission between the cover 1 and the air filter box 23. In the central area of the cover edge 5, the cover 1 is provided with recessed receptacles 27 for the correlated spring clips 2. In the recessed receptacles 27 a locking edge 28 is formed which is engaged by a locking nose 29 of the correlated spring clip 2 in the mounted state.

In the air filter box 22, two metal stays 17 are fastened that form a flexible attachment point 31 for each of the spring clips 2. In the mounted state of the cover 1 in which the locking nose 29 of the spring clips 2 are snapped into place behind the respective locking edge 28, the spring clip 2 and also the metal stay 17 are subjected to a tensile load that exerts a clamping force on the locking edge 28 of the cover 1 and locks the cover 1 in the clamping direction indicated by arrow 6. The oppositely acting pressure forces between the cover 1 and the air filter box 22 are received by the primary supports 7, 8 as well as by additional supports 16, not illustrated in FIG. 2 but described infra.

For forming the primary supports 7, 8, pins 11 are formed as monolithic parts of the cover 1; like the cover 1, the pins 7, 8 are made from plastic material, in the illustrated embodiment of fiberglass-reinforced polyamide. The longitudinal axis of the pins 11 are positioned approximately parallel to the longitudinal axis of the spring clips 2 in the clamped state, i.e., approximately parallel to the clamping direction 6. At the free ends 30 of the pins 11, a conical end member 14 of elastomeric plastic material is attached, respectively.

For receiving the pin 11 and end member 14, a receiving sleeve 12 made from metal, in particular, steel, is provided, respectively, which is secured in a receptacle 32 of the air filter box 22.

In the perspective illustration according to FIG. 2, it is shown that along the illustrated cover edge 5 a total of two pins 11 as well as approximately centrally between the pins 11 the recessed receptacle 27 for the correlated spring clip 2 are arranged. The oppositely positioned cover edge (not illustrated) to the rear is provided with an identical mirror-symmetrical configuration: a recessed receptacle is provided for the additional spring clip 2 to the rear of the illustration of FIG. 2 and two additional pins are also provided. As a whole, for attaching and clamping the cover 1 on the air filter box 22, two primary supports 7 and two primary supports 8 as well as two spring clips 2 are provided.

Figure 3:
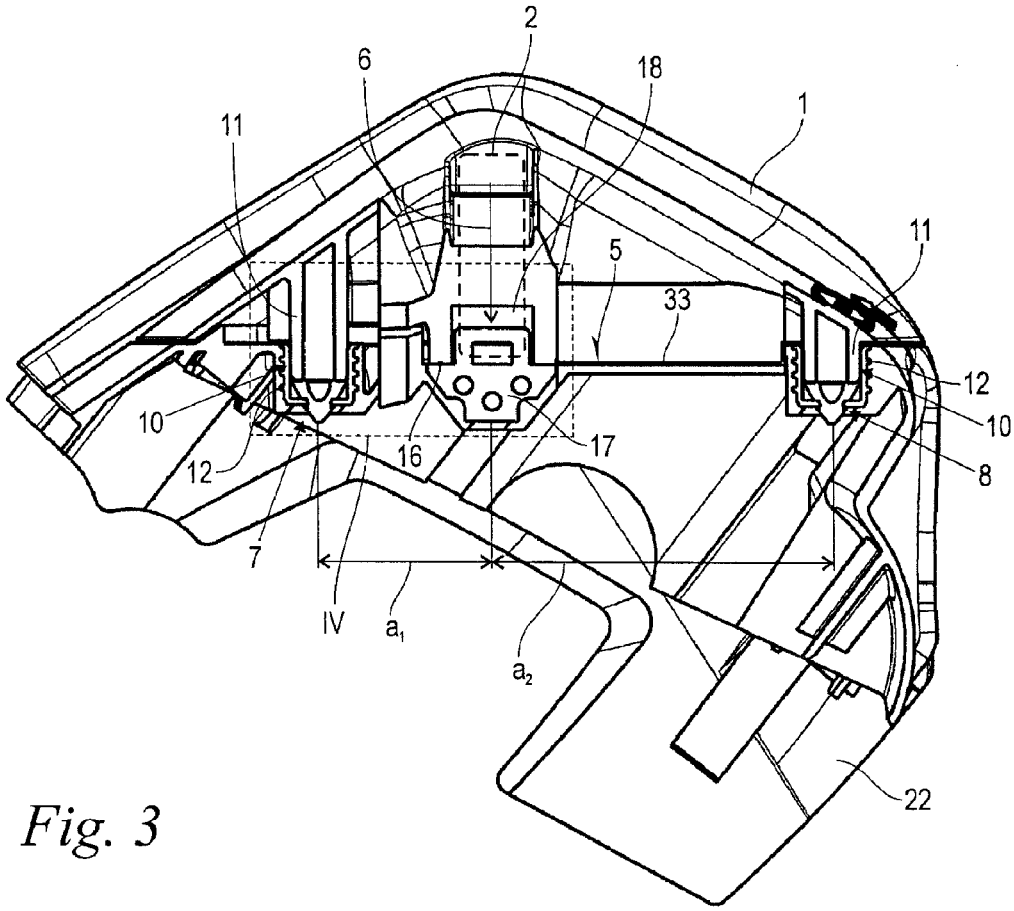
FIG. 3 is a longitudinal section of the arrangement according to FIG. 2 in the assembled state.

FIG. 3 shows a longitudinal section illustration of the arrangement according to FIG. 2 in the mounted state. It can be seen that along the illustrated cover edge 5 two primary supports 7, 8 are provided that act in the clamping direction 6. The spring clip 2, arranged at the exterior and not visible in the illustrated interior view and therefore shown only in dashed lines, is arranged between the support 7 and 8, when viewed transversely to the clamping direction 6 in a lateral direction that is defined by the cover edge 5; it has a lateral spacing $a_1$ relative to the first support 7 and a lateral spacing $a_2$ relative to the second support 8. It is possible to arranged the spring clip 2 centrally between the two primary supports 7, 8 wherein the ratio of lateral spacings $a_1$ and $a_2$ relative to one another is 1. In the illustrated embodiment, an off-center arrangement of the spring clip 2 is provided such that the lateral spacing $a_2$ to the second support 8 is approximated twice as large as the lateral spacing $a_1$ to the first support 7. The preferred range of the ratio of the two lateral spacings $a_1$ and $a_2$ relative to one another is approximately in 1 to 2½ (inclusive of 1 and inclusive of 2½) wherein the lateral off-center displacement of the spring clip 2 can also be provided in the direction toward of the second support 8.

An additional support 16 for the cover 1 is provided in the immediate action area of the spring clip 2. The additional support 16 acts, like the primary supports 7 and 8, in the clamping direction 6; in the illustrated embodiment it is coaxial to the longitudinal axis of the spring clip 2 in the closed state and thus to the clamping force in the clamping direction 6. The additional support 16 in the illustrated embodiment is formed by the metal stay 17 of the air filter box 22 that engages a receiving recess 18 of the cover 1. The receiving recess 18 is a monolithic part of the cover 1 and is comprised, like the cover, of fiber-reinforced plastic material. Details of the configuration of the additional support 16 will be described in connection with FIG. 4.

For providing the primary supports 7, 8, the pins 11 of the cover 1 engage the correlated sleeve 12 of the air filter box 22, respectively. In addition to their support function, the primary supports 7, 8 also provide a device 10 for lateral position securing by positive locking action of the cover 1 relative to the air filter box 22 in a direction transverse to the clamping direction 6.

Away from the supports 7, 8, 16, a gap 33 is provided between the cover edge 5 and the neighboring housing edge of the air filter box 22. The gap 33 has the effect that in the illustrated clamped state of the cover 1 (FIG. 3) between the cover and the air filter box 22 contact is provided only by means of the spring clip 1 and by means of the supports 7, 8, 16 or by means of the device 10 for lateral position securing are provided. The area of the oppositely positioned cover edge, not illustrated in FIG. 3, is configured in the same way.

Figure 4:
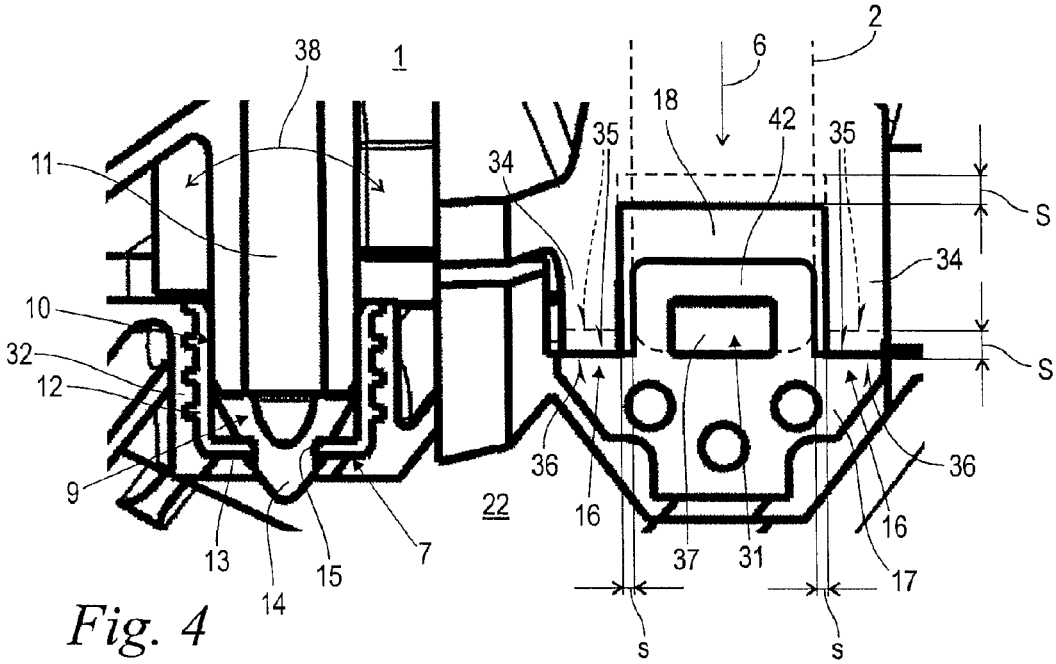
FIG. 4 is an enlarged illustration of the detail IV of FIG. 3 in the area of the forward support and the attachment point of the spring clip.

FIG. 4 shows an enlarged illustration of the detail IV of FIG. 3. It can be seen that the approximately cylindrical receiving sleeve 12 is provided at its exterior with circumferential ribs and is introduced into the correlated receptacle 32 of the plastic air filter box 22 during injection molding of the box 22. The receiving sleeve 12 is approximately cup-shaped and at the side facing away from the cover 1 is provided with bottom 13. Bottom 13 has centrally an opening 15 into which the elastic end member 14 of the pin 11 engages with its wedge shape. The elastic end member 14 is an elastic intermediate layer 9 of the support 7 that acts in the clamping direction 6. The elastic intermediate layer 9 is positioned between the pin 11 and the bottom 13 when viewed in the camping direction 6. In the clamping direction 6, a force transmission from the pin 11 is realized through the end member 14 onto the bottom 13 of the receiving sleeve 12.

The pin 11 of the support 7 rests with minimal play, provided transversely to the longitudinal axis and to the camping direction 6, in the lateral direction against the metal of the receiving sleeve 12. In this way, the cover 1 is positively fixed in position and secured relative to the air filter box 22 in the lateral direction. The lateral play has such a size that the pin 11 with elastic pretension of its end member 14 can perform a minimal lateral swivel movement in accordance with double arrow 38 without abandoning its function as a lateral position securing device. The support 8 illustrated in FIG. 3 is designed accordingly.

The illustration of FIG. 4 also shows that the receiving recess 18 in the cover 1 for receiving the metal stay 17 is limited in the lateral direction by two posts 34. The two posts 34 each have an end face 35 at their free end facing the metal stay 17 in the clamping direction 6; the end faces 35 are provided for contacting the correlated contact surfaces 36 of the metal stay 17.

In a state of the cover 1 in which it is placed onto the air filter box 22 but the spring clip 2 is not yet clamped, the end members 14 and also the cover 1 are not yet deformed. In this unloaded state of the spring clips 2, the cover 2 in the area of the receiving recess 18 is in a position that is illustrated by dashed lines. In this position, the end faces 35 that provide the additional support 16 and the contact surfaces 36 have a play S in the clamping direction 6.

When clamping the spring clip 2 in the clamping direction 6, the spring clip 2 is elastically deformed and generates a clamping force acting on the cover 1 in the clamping direction 6. The end members 14 are also elastically deformed in the clamping direction 6. Also, the cover 1 can experience an elastic deformation, for example, in the form of sagging, that is not impaired (or only minimally) because of the pivotability of the pins 11 in the direction of double arrow 38. A further elastic deformation component can also be provided in the air filter box 22. The play S (illustrated in the drawing disproportionally large) of the additional support 16 is dimensioned such that it can be overcome by the elastic total deformation of the aforementioned component groups. In the clamped state of the cover 1 or of the spring clip 2, the end faces 35 rest pretensioned against the support surfaces 36.

The bow 42 that is formed as a monolithic part of the metal stay 17 surrounds a slot 37 that forms of flexible fasting point 31 for the spring clip 2. In the illustrated embodiment, the spring clip 2 is secured captively on the bow 42. The reverse arrangement can also be expedient: the spring clip 2 is secured on the cover 1 and snaps into place, for example, at the metal stay 17 provided in the air filter box 22.

The bow 42 projects into the receiving recess 18 with lateral play s provided at both sides. A lateral spacing between the posts 34 and the bow 42 ensures that the cover 1 is not guided in the area of the spring clip 2 relative to the air filter box 22 in the direction transverse to the clamping direction 6. In deviation from the configuration of the primary supports 7, 8, in the area of the additional support 16 no device for lateral position securing is provided. The area of the spring clip 2 serves only for applying a clamping force in the clamping direction 6 as well as a counteracting pressure force in the additional support 16.

Figure 5:
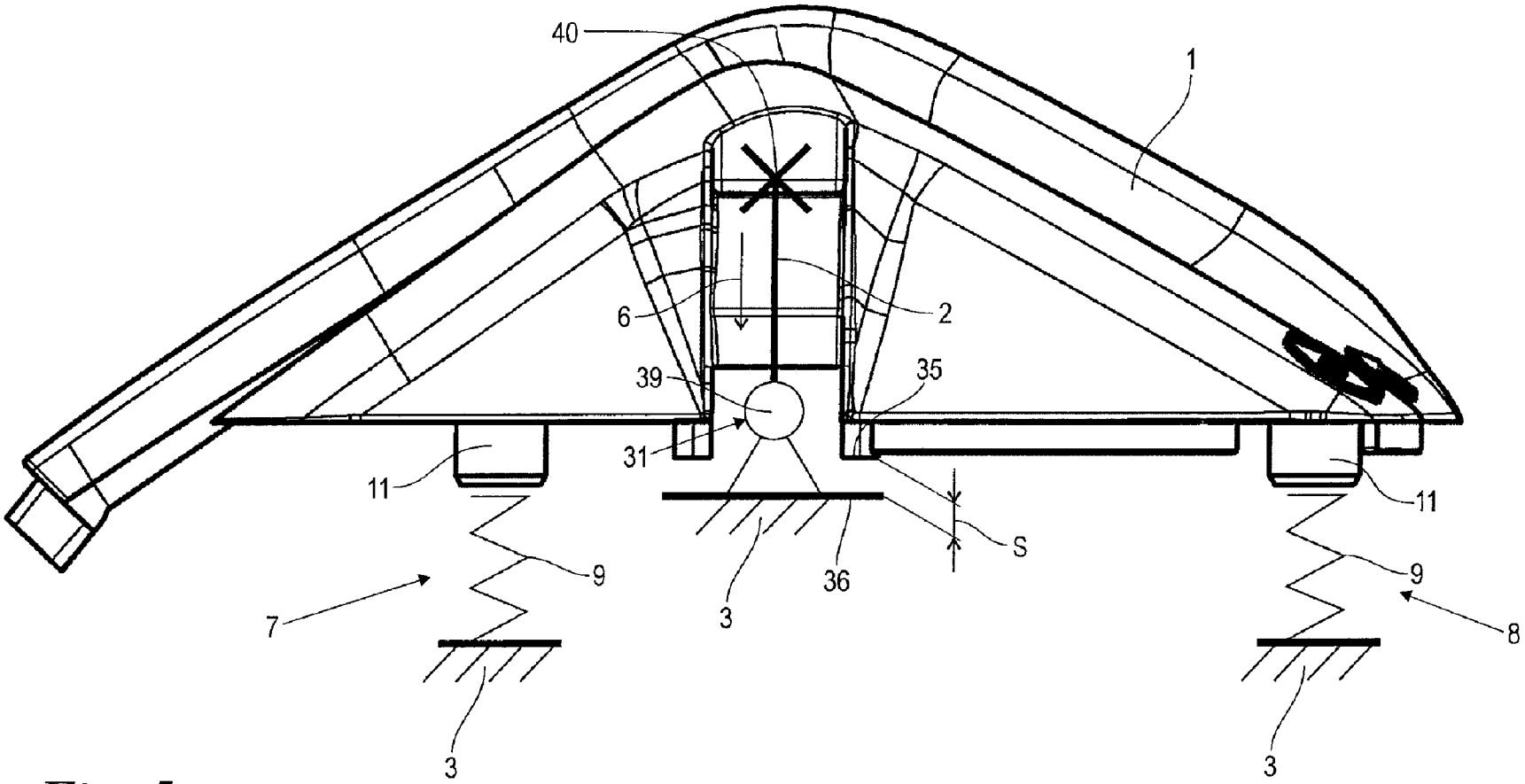
FIG. 5 is a side view showing schematically the elastic elements as they are acting in the clamped state.

The schematic illustration according to FIG. 5 shows the interaction of the elastic components as they act in the clamped state of the cover 1 relative to the part 3. The elastic intermediate layers 9 are supported in the clamping direction 6 on the part 3. The same holds true also for the attachment point 31 of the spring clip 2.

In the clamped state, the spring clip 2 engages with its end opposite the attachment point 31 the attachment point 40 of the cover 1 and clamps the cover 1 in the clamping direction 6 relative to the part 3. The fasting point 31 of the spring clip 2 at the part 3 acts in the embodiment of FIG. 4 as an articulation 39. In this way, it is ensured that the spring clip 2 is loaded essentially in the direction of its longitudinal axis. The clamping direction 6 is positioned in the longitudinal axis of the spring clip 2. The intermediate layers 9 are positioned in the clamping direction 6 between the pins 11 and the part 3 and are compressed by the action of the pretension force of the spring clips 2. Moreover, the cover 1 is exposed in the area between the primary supports 7, 8 to a bending load and a bending deformation resulting from the bending load as a result of the tensile force within the spring clip 2 and the pressure force at the primary supports 7, 8.

The cover 1 and the intermediate layers 9 are shown without deformation so that play S is provided between the end faces 35 and the correlated contact surfaces 36. Under the effect of the aforementioned elastic deformation, the end faces 35 come to rest against the correlated support surfaces 36.

In the illustrated embodiment, the primary supports 7, 8 and the device 10 for lateral position securing are formed by securing pins 11 that engage the receiving sleeves 12. It can also be expedient to provide along the cover edge 5 instead of the pins 11 and the receiving sleeves 12 edge sections that project past the cover edge 5 and engage suitable receiving grooves or folds of the part 3. A reverse arrangement can also be advantageous in which the aforementioned edge sections are arranged on the part 3 and the correlated receiving grooves or folds are arranged in the area of the cover edge 5.

The specification incorporates by reference the entire disclosure of German priority documents 20 2005 007 594.9 having a filing date of May 13, 2005 and of German priority document 10 2006 003 207.1 having a filing date of Jan. 24, 2006.

While specific embodiments of the invention have been shown and described in detail to illustrate the inventive principles, it will be understood that the invention may be embodied otherwise without departing from such principles.

What is claimed is:

1. A housing cover arrangement of a hand-held power tool, the housing cover arrangement comprising:

a cover having a lateral surface and a cover edge delimited the lateral surface;

at least one spring clip removably connecting the cover to a part of the power tool;

wherein the at least one spring clip, when securing the cover to the part, is disposed on the lateral surface in the area of the cover edge and is oriented in a damping direction that extends transversely to the cover edge;

at least two primary supports disposed along the cover edge and acting in the clamping direction;

wherein the at least one spring clip is arranged between the at least two supports;

wherein, at least in a state in which the cover is placed onto the part of the power tool but the at least one spring clip is not yet clamped, the cover edge has a play in the clamping direction relative to the part of the power tool between the at least two supports, wherein, as a result of a clamping force exerted by the at least one spring clip upon clamping, at least one of the cover and the part of the power tool is elastically deformable in a direction of the clamping force and the play.

2. The housing cover arrangement according to claim 1, wherein the at least two primary supports comprise a first support and a second support, wherein the at least one spring clip is spaced at a first lateral spacing from the first support and at a second lateral spacing from the second support, wherein a ratio of the first and second lateral spacings is within a range of approximately 1 to 2½, inclusive of 1 and 2½.

3. The housing cover arrangement according to claim 2, wherein the range of the ratio is 1 to 2, inclusive of 1 and 2.

4. A housing cover arrangement of a hand-held power tool, the housing cover arrangement comprising:

a cover having a lateral surface and a cover edge delimited the lateral surface;

at least one spring clip removably connecting the cover to a part of the power tool;

wherein the at least one spring dip, when securing the cover to the part, is disposed on the lateral surface in the area of the cover edge and is oriented in a clamping direction that extends transversely to the cover edge;

at least two primary supports disposed along the cover edge and acting in the clamping direction;

wherein the at least one spring clip is arranged between the at least two supports:

wherein the at least two primary supports each comprise an elastic intermediate layer.

5. The housing cover arrangement according to claim 4, wherein the elastic intermediate layer is made from elastomeric plastic material.

6. The housing cover arrangement according to claim 4, wherein in the area of the at least two primary supports a device for lateral position securing in a direction transverse to the clamping direction is provided, respectively.

7. The housing cover arrangement according to claim 6, wherein each one of the at least two primary supports and the correlated device for lateral position securing are formed by a pin and a receiving sleeve for receiving the pin, wherein the elastic intermediate layer is arranged between the pin and a bottom of the receiving sleeve in the clamping direction.

8. The housing cover arrangement according to claim 7, wherein the elastic intermediate layer is an end member of the pin, wherein the end member in cross-section has a wedge shape and engages an opening in the bottom of the receiving sleeve, wherein the pin has minimal lateral play relative to the receiving sleeve.

9. The housing cover arrangement according to claim 7, wherein the pin is a plastic pin and the receiving sleeve is a metal sleeve, wherein the plastic material of the plastic pin rests laterally against the metal of the metal sleeve.

10. The housing cover arrangement according to claim 1, wherein the cover has no guiding function in the area of the at least one spring clip in a lateral direction transverse to the clamping direction.

11. The housing cover arrangement according to claim 1, further comprising an additional support arranged in an immediate action area of the at least one spring clip, wherein the additional support acts in the clamping direction and has lateral play.

12. The housing cover arrangement according to claim 11, wherein the additional support, when the at least one spring clip is unloaded, has play in the clamping direction of such a size that in a clamped state of the spring clip the play is overcome by elastic deformation of neighboring components of the housing cover arrangement.

13. The housing cover arrangement according to claim 11, wherein the additional support comprises a metal stay and a plastic receiving recess for receiving the metal stay.

14. The housing cover arrangement according to claim 11, wherein the metal stay provides an attachment point for the at least one spring clip.

* * * * *